United States Patent [19]

Schroeder et al.

[11] 4,095,205

[45] June 13, 1978

[54] TRANSFORMER WITH IMPROVED INSULATOR

[75] Inventors: Stephen M. Schroeder; George P. Michel, both of South Boston, Va.

[73] Assignee: Westinghouse Electric Corp., Pittsburgh, Pa.

[21] Appl. No.: 819,804

[22] Filed: Jul. 28, 1977

[51] Int. Cl.[2] ..... H01C 27/32

[52] U.S. Cl. ..... 336/92; 174/25 R; 174/110 PM; 336/94; 336/206

[58] Field of Search ..... 336/90, 92, 94, 197, 336/206; 174/25 R, 17 R, 110 F, 110 PM, 110 N

[56] References Cited

U.S. PATENT DOCUMENTS

| | | | |
|---|---|---|---|
| 2,777,009 | 1/1957 | Whitman | 174/17 R X |
| 2,845,472 | 7/1958 | Narbut | 174/17 R X |
| 3,194,872 | 7/1965 | Garner | 174/25 R |
| 3,374,453 | 3/1968 | Broverman et al. | 336/197 |
| 3,427,394 | 2/1969 | McKean | 174/25 R X |
| 3,585,552 | 6/1971 | Feather | 174/25 R |
| 3,594,489 | 7/1971 | Katz | 174/25 R |
| 3,773,965 | 11/1973 | Reynolds | 174/110 F X |
| 3,959,549 | 5/1976 | Penczynski et al. | 174/110 PM |

*Primary Examiner*—Thomas J. Kozma
*Attorney, Agent, or Firm*—William M. Hanlon, Jr.

[57] ABSTRACT

Electrical apparatus having certain portions thereof insulated with solid insulating structures. The solid insulating structures include a predetermined thickness of polyethylene terephthalate film which is surrounded on each of its major outer surfaces by a layer of paper having a fibrous web formed of wholly aromatic polyamide fibers.

13 Claims, 3 Drawing Figures

TRANSFORMER WITH IMPROVED INSULATOR

BACKGROUND OF THE INVENTION

1. Field of the Invention

This invention relates, in general, to electrical apparatus and, more specifically, to insulating structures for electrical transformers.

2. Description of the Prior Art

Insulation is required for electrical inductive apparatus, such as transformers, to insulate the electrical conducting elements from each other and from ground and, thereby, give the transformer the ability to withstand normal and overload conditions and, also, impulse voltages. Cellulosic materials, such as kraft paper and pressboard, have been employed in liquid-filled transformers due to their excellent dielectric properties and low cost. However, the physical and electrical properties of these cellulostic materials deteriorate at an increasing rate when the operating characteristics of the transformer rise above 100° C thereby limiting the rating and the average operating temperature of transformers employing these materials due to their thermal instability. Indeed, cellulostic materials cannot be used in certain transformer constructions, such as those employing a liquid which vaporizes within the normal operating temperature range of the transformer to provide cooling and insulation therefor, since such transformers operate at a temperature considerably higher than the average temperature in conventional liquid-filled transformers thereby eliminating cellulostic materials as a viable insulation alternative.

In such transformers or even liquid-filled transformers having a rating and average temperature above the allowable range of cellulostic materials, an insulative material comprised of wholly aromatic polyamide fibers, such as one sold commercially under the trade name "NOMEX", has proved effective. As explained in greater detail in U.S. Pat. No. 3,585,552, issued to L. Feather, the use of such material in the insulating structures provides a substantial increase in insulative qualities over cellulostic materials. However, insulating structures comprised solely of wholly aromatic polyamide fibers are quite costly. Thus, it would be desirable to provide an insulating structure for an electrical inductive apparatus, such as a transformer, which provides substantially the same insulating properties as a paper formed of wholly aromatic polyamide fibers, but at a reduced cost.

Other dielectric films, such as polyester films, have been thought to be unsuited for use as solid insulation in most transformer applications as the electrical impulse strength of these materials drops rapidly when used in thicknesses above 5 mils. In addition, such films embrittle quickly at temperatures above 200° C and, also, exhibit plastic flow at the temperatures and pressures experienced during a short circuit of a transformer. However, the polyester films are relatively inexpensive when compared to papers formed of wholly aromatic polyamide fibers and, furthermore, have a higher dielectric strength in the non-condensable gas environment commonly used in vaporization cooled transformers.

Thus, it would be desirable to provide an insulating structure for certain electrical apparatus, such as electrical transformers, that enables the inexpensive polyester films to be used in such a manner so as to take advantage of certain of their superior electrical characteristics while, at the same time, minimizing the effects of their less advantageous properties.

SUMMARY OF THE INVENTION

Herein disclosed is a new and improved electrical apparatus, such as a transformer, having certain portions thereof insulated by solid insulating means. The solid insulating means or structures are formed of a predetermined thickness of a polyethylene terephthalate film which is surrounded on both its major outer surfaces by a layer of a paper having a fibrous web formed of wholly aromatic polyamide fibers. It has been unexpectedly found that the insulation sandwich of polyethylene terephthalate film and a paper formed of wholly aromatic polyamide fibers provides essentially the same electrical characteristics as does an insulating structure consisting entirely of a paper formed of wholly aromatic polyamide fibers despite the fact that the impulse strength of the polyethylene terephthalate film is known to decrease rapidly when used in thicknesses above 5 mils, such as is required in transformer applications. The aforementioned insulation sandwich provides a synergistic result since the use of the polyethylene terephthalate film does not lower the overall impulse strength of the insulating structure as would normally be expected. The high temperature resistance and mechanical strength of the paper formed of wholly aromatic polyamide fibers protects the polyethylene terephthalate film from the high temperatures and pressures existing in certain portions of the transformer thereby preventing the plastic flow and embrittlement of the polyethylene terephthalate film that would normally occur at the temperatures and pressures encountered, for example, during a short circuit of the transformer. At the same time, the use of the polyethylene terephthalate film, which forms a major portion of the insulating structure, provides a significant cost savings since it is substantially less expensive than the wholly aromatic polyamide paper. In addition, the polyethylene terephthalate film provides increased dielectric strength in certain transformer constructions, such as those using a vaporizable liquid and a non-condensable gas, such as sulfur hexafluoride ($SF_6$) for cooling and insulation.

BRIEF DESCRIPTION OF THE DRAWINGS

The various features, advantages and other uses of this invention will become more apparent by referring to the following detailed description and drawing in which.

DESCRIPTION OF THE PREFERRED EMBODIMENT

Figure 1:
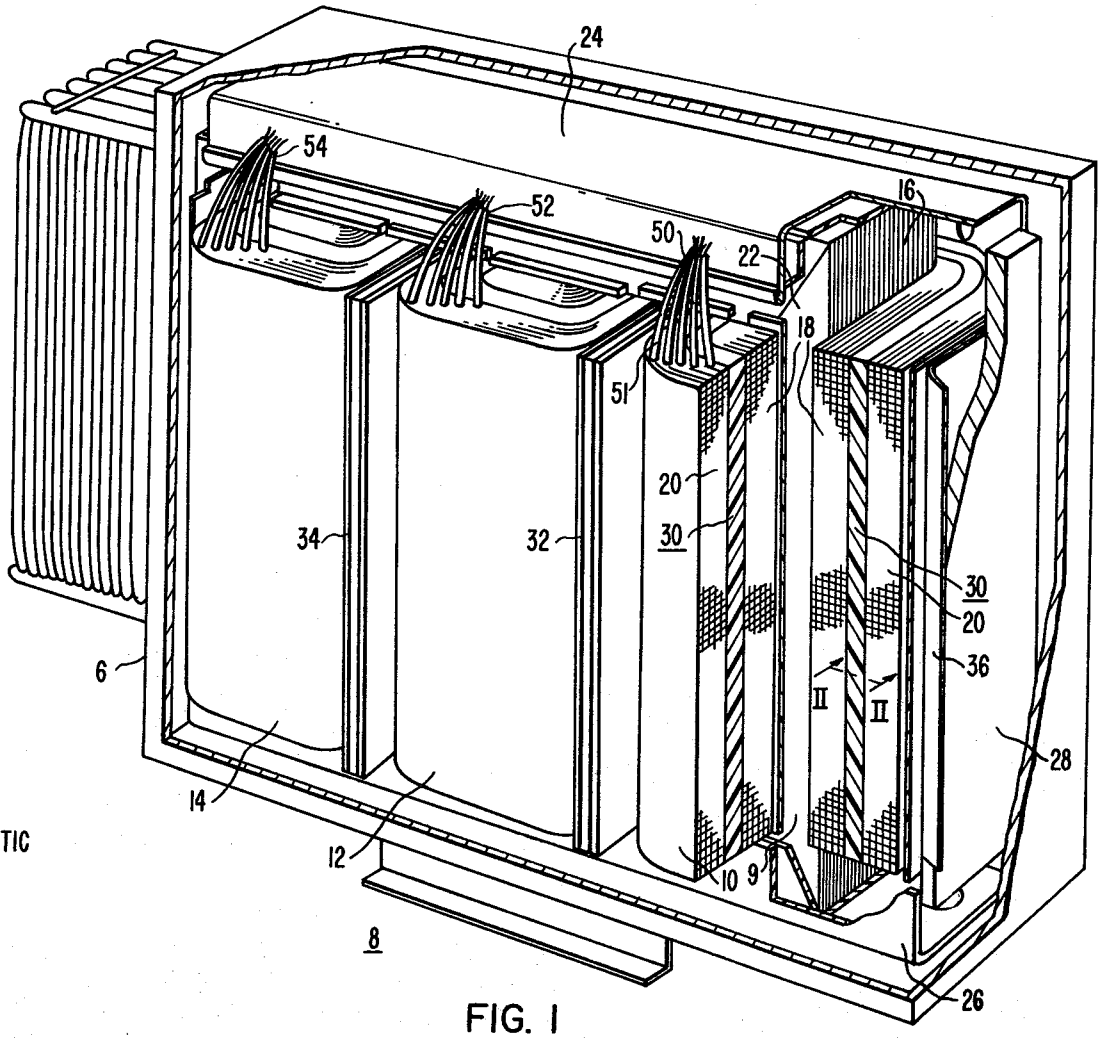
FIG. 1 is a perspective view, partially cut away, of a transformer which may utilize the teachings of this invention.

Certain types of electric apparatus, such as electrical transformers, require insulating structures to electrically insulate the conducting components from each other and from ground. Cellulostic materials, such as kraft paper and pressboard, have been widely used due to their low cost and excellent insulating characteristics when impregnated with a liquid insulating dielectric, such as transformer oil. However, the electrical insulating qualities and mechanical strength of the cellulostic insulation deteriorate rapidly at temperatures above 100° C. Thus, the use of cellulostic insulation limits the average operating temperature of a transformer due to the limited thermal stability of such materials.

In transformers having higher operating temperatures above the allowable range of cellulostic materials, a synthetic paper formed of wholly aromatic polyamide fibers, such as one sold commercially under the trade name "NOMEX", has been widely used. This material is able to take temperatures up to 220° C continuously without losing its mechanical and electrical integrity. As noted in U.S. Pat. No. 3,585,552, the use of a synthetic paper, formed of wholly aromatic polyamide fibers, in the insulating structure of the transformer provides superior electrical insulating characteristics over cellulostic materials but, however, at a considerably higher cost.

Other less expensive synthetic insulating films of the polyester type and, more specifically, a polyethylene terephthalate film, such as one sold commercially under the trade names "MYLAR", "CELNAR" and a similar product known as "KODAR", have heretofore been thought to be unsuitable for use as solid insulation in most types of electrical transformers. As is noted in U.S. Pat. No. 3,585,552, the impulse strength of these films, in volts per mil, decreases rapidly with increased thickness, especially above 5 mils, which makes their use in the thicknesses required in power transformers unacceptable. In addition, the polyethylene terephthalate film embrittles quickly at the 220° C to 250° C temperatures experienced during a short circuit of the transformer. Furthermore, the sharp corners of the conductors of the transformer cause plastic flow of the polyethylene terephthalate film due to the high pressures existing therebetween during a short circuit. This material is known to embrittle in the presence of water above 90° C which prohibits its use with cellulostic materials in oil-filled transformers since the cellulostic materials liberate water during the use thereof which degrades the remaining insulating structure. However, polyethylene terephthalate films offer high dielectric strength especially in a non-condensable gas atmosphere commonly used in vaporization-cooled transformers and are significantly less expensive than the paper formed of wholly aromatic polyamide fibers.

The present invention is a new and improved electrical apparatus which utilizes the discovery that a predetermined thickness of polyethylene terephthalate film surrounded on both major exterior surfaces by layers of a paper having a fibrous web formed of wholly aromatic polyamide fibers provides essentially the same electrical characteristics as an insulating structure formed entirely of the wholly aromatic polyamide fiber paper. More specifically, the above described sandwich insulation means or structure provides essentially the same impulse strength and corona resistance as does an insulating structure formed entirely of the polyamide paper but at a considerably less cost.

To illustrate the synergistic effect exhibited by the sandwich insulation structure formed of a predetermined thickness of polyethylene terephthalate film surrounded by layers of a paper formed of wholly aromatic polyamide fibers, when used as electrical insulation for a transformer, tests were made to determine the impulse strength and the corona resistance of the above described sandwich insulation structure and another insulation structure constructed entirely of a paper formed of wholly aromatic polyamide fibers. The sandwich insulation structure sample was 0.375 inches thick and consisted of a plurality of layers of polyethylene terephthalate film built up to a total thickness of 0.335 inches which was surrounded by a layer of a paper formed of wholly aromatic polyamide fibers, 0.020 inches thick, on either side of the polyethylene terephthalate film; while the other sample consisted of a plurality of layers of a paper formed of wholly aromatic polyamide fibers which was subjected to a calendering process wherein pressure is applied to the paper to increase its density, and built up to a total thickness of 0.375 inches.

All of the test samples were first heated to 125° C for 12 to 24 hours. They were then placed in a tank and a vacuum of less than 1 mm of mercury absolute was drawn for 2 hours to insure that the samples were dry and free of air. A typical transformer environment, such as a sulfur hexafluoride ($SF_6$) gas or a liquid mixture consisting of 75% $C_2Cl_4$ and 25% mineral oil was introduced into the tank under the full vacuum, filled to atmospheric pressure and allowed to soak into the samples of 1 hour to insure complete impregnation. The samples undergoing tests were then placed between two aluminum strap electrodes with the ends of the insulation structures extending 3 inches beyond the electrodes. One of the electrodes was connected to a high voltage source; while the other was connected to ground.

The first test to be performed on the samples was the impulse test. In this test, an impulse voltage with a rise time of 7 $\mu$ seconds is applied to one of the electrodes and the voltage at which flashover, either around the end of the insulation or a puncture through the insulation, occurred is recorded. After testing several samples in this manner, the average flashover voltage is multiplied by 0.95 to give a check voltage. Then a test impulse wave at the check voltage is applied to a sample wherein the impulse wave has a rise time of 1.2 $\mu$ seconds and a fall time of 50 $\mu$ seconds to a voltage which is one-half of the value at the peak at 1.2 $\mu$ seconds. In a successful test, there should be no flashover at the check voltage. The results of the impulse tests on the two samples in both a non-condensable gas environment and in a liquid environment are summarized in Table 1.

TABLE I

| | | IMPULSE TEST | | |
|---|---|---|---|---|
| | | IN $SF_6$ GAS (at atm. pressure) | | IN LIQUID (75% $C_2Cl_4$ and 25% OIL) |
| SAMPLE | | Average 7$\mu$sec flashover voltage | 1.2$\mu$ sec × 50$\mu$ sec check voltage | Average 7$\mu$ sec flashover voltage |
| wholly aromatic polyamide fiber paper | | 128.24 KV(neg.) | 121.83 KV | 187.92 KV |
| | test | | | |
| wholly aromatic polyamide fiber | 1 | 142.4 KV(neg.) | | |

TABLE I-continued

| SAMPLE | | IMPULSE TEST IN $SF_6$ GAS (at atm. pressure) Average 7μsec flashover voltage | 1.2μ sec × 50μ sec check voltage | IN LIQUID (75% $C_2Cl_4$ and 25% OIL) Average 7μ sec flashover voltage |
|---|---|---|---|---|
| paper and polyethylene terephthalate film sandwich | 2 | 132.4 KV(neg.) | 126 KV | 169.4 KV |
| | 3 | 164.4 KV(pos.) | | |

In interpreting these test results, it should be pointed out that prior testing has shown that a sample constructed of wholly aromatic polyamide paper has the same 7 μ second flashover value for either negative or positive polarity of the impulse test wave.

The results in Table I shown that the sandwich insulation structure consisting of a layer of polyethylene terephthalate film surrounded by layers of a paper formed of wholly aromatic polyamide fibers has essentially the same impulse strength in the non-condensable gas environment as does the insulation structure formed entirely of a paper constructed of wholly aromatic polyamide fibers. Thus, the sandwich insulation structure may be used as electrical insulation for a transformer without the expected decrease in impulse strength. This synergistic effect resulted despite the fact that the impulse strength of the polyethylene terephthalate film decreases rapidly when used in thicknesses greater than 5 mils. This is further shown since the flashover occurred during the impulse test by breaking down the non-condensable gas atmosphere surrounding the test sample, not by puncturing through the insulating structure. In a liquid environment, which is commonly used in vaporization-cooled transformers wherein the windings are completely immersed in the dielectric fluid, the aforementioned sandwich insulation structure was found to be slightly weaker than the sample formed entirely of the wholly aromatic polyamide fiber paper. Although no impulse tests at the check voltages were made on the samples in the liquid environment, the 7 μ second flashover voltage results show the basic characteristics of the samples in the liquid mixture.

Table II lists the results of corona tests on the same types of samples.

TABLE II

| Sample | test | CORONA TEST (at atm. pressure) Inception KV RMS | Extinction KV RMS |
|---|---|---|---|
| .375 thick of calendered aromatic polyamide paper in gas (60% $SF_6$, 30% $N_2$ and 10% $Freon_{114}$) | | 15.0 | 14.5 |
| .375 thick sandwich of .335" polyester film surrounded by 2-.020" thick polyamide paper layers in 100% $SF_6$ gas | 1 | 15.2 | 14.0 |
| | 2 | 16.8 | 14.4 |
| | 3 | 16.0 | 14.3 |

In the corona test, the sample constructed entirely of calendered wholly aromatic polyamide paper was tested in a gas environment consisting of 60% $SF_6$, 30% nitrogen and 10% $freon_{114}$ which, previous tests have shown, produces the same results as does a gas environment consisting entirely of $SF_6$. Overall, these results show that the sandwich insulation structure of calendered polyamide paper and polyethylene terephthalate film is essentially equivalent to an insulating structure formed entirely of calendered polyamide paper for corona resistance.

Based on the above tests, the insulating structure consisting of a predetermined thickness of polyethylene terephthalate film surrounded by layers of calendered paper formed of wholly aromatic polyamide fibers may be used in place of insulation constructed entirely of the polyamide paper in certain of the major electrical insulating structures of an electrical transformer without any loss of electrical insulating characteristics. It is felt that the layers of the polyamide paper protect the polyethylene terephthalate film from the high temperatures occurring in certain portions of the transformer by dissipating the heat before it reaches the polyethylene terephthalate film. In addition, the high mechanical strength of the layers of polyamide paper protect the polyethylene terephthalate film from the pressures exerted by the sharp corners of conductors during a short circuit which prevents plastic flow and embrittlement of the polyethylene terephthalate film that would normally occur if such film was used by itself.

Referring now to FIG. 1, there is shown an electrical transformer 8 of the type which may advantageously utilize the aforementioned sandwich insulation structure in certain of the major insulation structures thereof. More specifically, transformer 8 includes a magnetic core and coil assembly 9 which is disposed within a tank or enclosure 6. Dielectric fluid means, not shown, are disposed within the tank 6 for cooling and insulating purposes and may include filling the tank 6 to a level above the core and coil assembly 9 with a suitable liquid dielectric, such as transformer oil. In addition, the dielectric fluid means may include a vaporization cooling system wherein a dielectric fluid, vaporizable within the normal operating temperature range of the transformer 8, such as perchloroethylene ($C_2Cl_4$), is applied to the core and coil assembly 9 in a thin film by suitable supply means or may totally immerse the core and coil assembly 9. In either event, the vaporizable dielectric fluid vaporizes as it contacts the heat producing elements of the core and coil assembly 9 and thereby removes heat in quantities equal to the latent rate of vaporization of the dielectric fluid. Other examples of suitable vaporizable dielectric fluid can be found by referring to U.S. Pat. No. 2,845,472, issued to Maslin and Narbut.

Transformer 8, according to the preferred embodiment of this invention, is a three-phase transformer of the core-form type, having a magnetic core 16 with phase windings 10, 12 and 14 disposed in inductive relation about the winding legs of the magnetic core 16. Each phase winding assembly includes a low voltage winding and a high voltage winding, each consisting of either strap or sheet type conductors, concentrically disposed about a leg of a magnetic core 16, such as low voltage winding 18 and high voltage winding 20 disposed about leg 22 of the magnetic core 16. High voltage lead groups 50, 52 and 54 are connected to the high voltage windings of phase winding assemblies 10, 12 and 14, respectively. Each lead group, such as lead group 50 associated with phase winding assembly 10, provides means for connecting the high voltage windings, such as high voltage winding 20, to a tap changing mechanism or terminal board arrangement, not shown, so that the leads may be connected differently, with respect to each other, to provide different high voltage winding ratings. The low voltage and high voltage bushings and leads normally connected to the high voltage and low voltage windings of each phase winding assembly are not shown. In addition, the core and coil assembly 9 is rigidly held in position by a top support 24, a bottom support 26 and side braces or end plates, such as end plate 28.

Throughout this discussion, the thicknesses of the materials used to construct the various insulating structures are described by way of example and not of limitation with regard to a 95 KV BIL rated transformer filled with $SF_6$ gas at atmospheric pressure. It is understood that transformers having different ratings and insulating environments would require insulating structures of varying thicknesses in order to provide the necessary electrical insulating characteristics; which changes, however, do not depart from the teachings of this invention.

Figure 2:
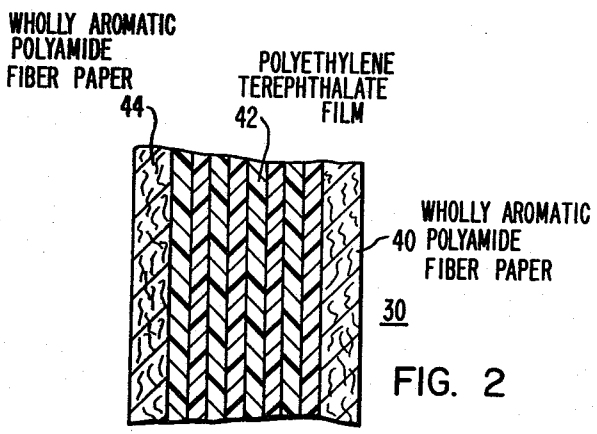
FIG. 2 is a sectional view, along line II—II in FIG. 1, showing a portion of an insulating structure constructed according to the teachings of this invention.

There is shown in FIG. 2, a diagrammatic crosssectional view of the sandwich insulation structure comprised of layers of polyethylene terephthalate film surrounded by layers of wholly aromatic polyamide fiber paper which may be used to advantage in certain of the insulating structures of the transformer 8. The sandwich insulation structure 38, includes a first layer 40 of a paper formed of wholly aromatic polyamide fibers which is 20 mils thick. Disposed in registry with the first layer 40 of insulative material is a plurality of layers, each 14 mils thick, of polyethylene terephthalatefilm which are stacked to the desired thickness in order to provide the necessary electrical insulating characteristics for a transformer. According to the example noted above, 24 layers of 14 mil thick polyethylene terephthalate film is required to provide electrical insulation for a 95 KV BIL rated transformer. A second layer 44, 20 mils thick of a paper formed of a wholly aromatic polyamide fiber is disposed in registry with the top layer of the polyethylene terephthalate film 42 to complete the sandwich insulation structure 38. As noted above, the number of layers of polyethylene terephthalate film utilized to form the sandwich insulation structure may be varied in order to provide the proper electrical insulative characteristics for a wide range of transformer insulating requirements.

Referring again to FIG. 1, the first location in transformer 8 where the sandwich insulation structure, consisting of a predetermined thickness of polyethylene terephthalate film surrounded on both major surfaces by a layer of a paper formed of wholly aromatic polyamide fibers, could be used to advantage would be the insulation structure disposed in the high-low space between the high voltage and low voltage windings of each phase assembly, such as the insulating structure 30 disposed between the low voltage winding and the high voltage winding, 18 and 20, respectively, of the phase winding assembly 10. As shown more clearly in FIG. 2, the insulating structure 30 is constructed by winding a first layer 40 of a paper formed of wholly aromatic polyamide fibers, 20 mils thick around the outermost turn of the low voltage conductor 18. Next, 24 layers 42 of 14 mil thick polyethylene terephthalate film are wound around the first layer 40 of the polyamide paper and are in turn surrounded by a second layer 44, 20 mils thick, of a paper formed of wholly aromatic polyamide fibers before the high voltage winding 20 is wound around the insulating structure 30 to complete the phase winding 10. The insulating structure 30 consisting of layers of polyethylene terephthalate film surrounded by layers of wholly aromatic polyamide fiber paper built to a total thickness of 0.376 inches provide the necessary electrical insulation between the low voltage winding 18 and the high voltage winding 20 of the phase winding assembly 10. The thickness shown for each layer of polyethylene terephthalate film and wholly aromatic polyamide fiber paper are those in which such materials are commonly available. However, different thicknesses of each layer of material may also be used without departing from the teachings of this inventions.

The novel sandwich insulation which is the subject of this invention may also be used to advantage in the phase-to-phase insulation between adjoining phase winding assemblies of the transformer 8, such as insulating structures 32 and 34 shown in FIG. 1. In this application, the polyethylene terephthalate film and the wholly aromatic polyamide fiber paper are cut into sheet form approximately the same dimensions as the phase windings of the transformer 8. The sheets of insulative material are then stacked together in a manner described above to the same total thickness of 0.376 inches in order to provide the necessary electrical insulation between the high voltage windings of adjacent phase winding assemblies. Similar sheets of insulative material may also be stacked together to the desired thickness of 0.376 inches and placed between the high voltage winding and the end plate 28 of the support structure, such as the insulative structure 36 disposed between the outer surface of the high voltage winding 20 of phase winding assembly 10 and the end plate 28 of the support structure for the transformer 8. The insulative structure 36 thus provides the necessary electrical insulation between the high voltage winding, which is at an electrical potential, and the grounded end plate 28 of the support structure for the transformer 8.

Other possible locations where the sandwich insulation structure constructed of layers of polyethylene terephthalate film surrounded by layers of wholly aromatic polyamide fiber paper may be used in the transformer 8 include the insulation between the low voltage winding and the core and also as layer insulation between the turns of the low voltage and high voltage conductors. These possible uses of the aforementioned sandwich insulation structure are less advantageous since an overload on the transformer 8 could cause the temperature of the core to rise to such a degree that it exceeds the thermal protection afforeded the polyethylene terephthalate film by the layers of the wholly aromatic polyamide fiber paper. When used as layer insulation, the sandwich insulation structure is exposed to extreme pressures during a short circuit by the sharp corners of the hot conductors which could break through the layers of the wholly aromatic polyamide fiber paper and cause embrittlement and plastic flow of the polyethylene terephthalate film thereby degrading the characteristics of the insulating structure.

Figure 3:
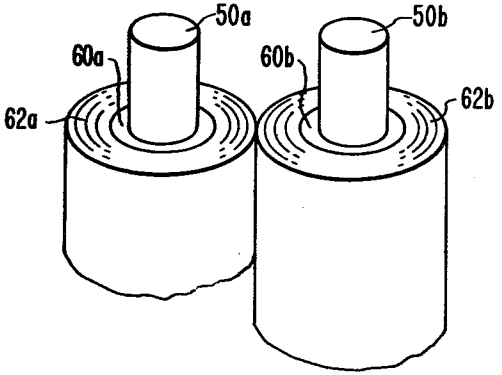
FIG. 3 is a diagrammatic, cross-sectional view of another embodiment of an insulating structure constructed according to the teachings of this invention.

The novel insulation sandwich of this invention may also be used as insulation for the high voltage lead groups 50, 52 and 54, connecting the high voltage windings to the tap-changer mechanism and also the high voltage cables which connect the high voltage windings to the high voltage bushings. As shown in FIG. 3, the insulating sandwich, such as the insulating structure associated with tap lead 50*a* of lead group 50, would include a first layer 60*a* of the wholly aromatic polyamide fiber paper, 20 mils thick surrounding the lead 50*a*. A plurality of layers 62*a*, each 14 mils thick, of polyethylene terephthalate film having a combined thickness of 0.180 mils is disposed in registry around the first layer 60*a* to complete the insulating structure for the tap lead 50*a*. Each group of tap leads, such as lead group 50, are normally bundled together and run from the high voltage windings to the tap changer. Thus, the insulation between adjacent tap leads 50*a* and 50*b*, for example, consists of 20 mils of polyamide paper and 180 mils of polyethylene terephthalate film for one tap lead, such as lead 50*a*, and 0.180 mils of polyethylene terephthalate film and 20 mils of polyamide paper surrounding the adjacent lead, such as lead 50*b*. The layers of the polyethylene terephthalate film associated with tap leads 50*a* and 50*b* are in contact with each other and, thus, provide the required amount of insulation between the adjacent leads and, further, are protected from each lead by two layers of the wholly aromatic polyamide paper. An additional layer of the wholly aromatic polyamide paper on the outside of the layers of polyethylene terephthalate film for each tap lead is not required since the polyethylene film is separated from each adjacent lead by the two innermost layers of polyamide paper around each lead. In addition, the film situated on the exterior of the bundle of tap leads is not subjected to high temperatures and pressures from any conducting portion of the transformer, only the dielectric fluid in the transformer tank which operates at much lower temperatures and pressures.

While this invention has been illustrated in combination with the three-phase transformer of the core-form type, it will be understood that it applies equally as well to single or polyphase electrical apparatus, and to transformers of the shell-form type, as well as to reactors and to any high voltage apparatus wherein electrical conductors are insulated with solid insulation.

In summary, there has been disclosed a new and improved electrical apparatus, such as a transformer, having certain portions thereof insulated by solid insulating structures. The solid insulating structure is formed of a predetermined thickness of a polyethylene terephthalate film which is surrounded on both major exterior surfaces by a layer of a paper having a fibrous web formed of a wholly aromatic polyamide fiber. The impulse strength and corona resistance of this sandwich insulation structure is essentially the same as that of the insulation structures formed entirely of a paper constructed of wholly aromatic polaymide fibers; however, the use of polyethylene terephthalate film in a major portion of each insulating structure affords a substantial cost reduction over insulation formed entirely of wholly aromatic polyamide fiber paper.

What is claimed is:

1. Electrical apparatus comprising:

an enclosure;

an electrical winding disposed within said enclosure and adapted for connection to an electrical potential;

a dielectric fluid disposed within said enclosure; and solid insulating means for electrically insulating at least a portion of said electrical winding;

said solid insulating means including a first layer of a paper consisting essentially of a fibrous web formed of wholly aromatic polyamide fibers, a second layer of a polyethylene terephthalate film having a thickness greater than 0.005 inches disposed in registry with said first layer and a third layer of a paper consisting essentially of a fibrous web formed of wholly aromatic polyamide fibers disposed in registry with said second layer.

2. The electrical apparatus of claim 1 wherein the first and third layers of the solid insulating means are formed of a calendered paper consisting essentially of a fibrous web formed of wholly aromatic polyamide fibers.

3. The electrical apparatus of claim 1 wherein the dielectric fluid is mineral oil.

4. The electrical apparatus of claim 1 wherein the dielectric fluid is a fluid which is vaporizable within the normal operating temperature and pressure range of said electrical apparatus.

5. The electrical apparatus of claim 1 wherein the dielectric fluid is a gas is substantially non-condensible over the normal operating temperature and pressure range of said electrical apparatus.

6. The electrical apparatus of claim 1 wherein the second layer of the solid insulating means includes a plurality of sheets of polyethylene terephthalate film.

7. The electrical apparatus of claim 1 wherein the electrical apparatus is a transformer having leads connecting the electrical winding to the source of electrical potential and, further, having second solid insulating means for electrically insulating said leads, said second solid insulating means including a first layer of a paper consisting essentially of a fibrous web formed of wholly aromatic polyamide fibers disposed around at least one of said leads and a second layer of a polyethylene terephthalate film having a thickness greater than 0.005 inches disposed around and in registry with said first layer of said second solid insulating means.

8. Electrical inductive apparatus comprising:

an enclosure;

a magnetic core disposed within said enclosure;

at least first and second electrical windings, each having a plurality of conductor turns, disposed in inductive relation around said magnetic core;

a dielectric fluid disposed within said enclosure; and solid insulating means for electrically insulating at least a portion of one of said first and second electrical windings;

said solid insulating means including a first layer of a paper consisting essentially of a fibrous web formed of wholly aromatic polyamide fibers, a second layer of a polyethylene terephthalate film having a thickness greater than 0.005 inches disposed in registry with said first layer and a third layer of a paper consisting essentially of a fibrous web formed of wholly aromatic polyamide fibers disposed in registry with said second layer.

9. The electrical inductive apparatus of claim 8 wherein the solid insulating means is disposed between the first and second electrical windings.

10. The electrical inductive apparatus of claim 9 wherein the first and second electrical windings are concentrically adjacent each other.

11. The electrical inductive apparatus of claim 9 wherein the solid insulating means is disposed between the first and second electrical windings and the magnetic core.

12. The electrical inductive apparatus of claim 9 wherein the solid insulating means is disposed to electrically insulate at least a portion of the conductor turns of at least one of the first and second electrical windings.

13. The electrical inductive apparatus of claim 8 further including a top support and a bottom support disposed adjacent the top and bottom portions of the magnetic core, respectively, and first and second end plates disposed adjacent at least a portion of the outermost turn of said first and second windings respectively, and interlocked with said top and bottom supports to provide a solid structure that resists movement of said first and second electrical windings during the operation of said electrical inductive apparatus, wherein the solid insulating means is disposed between said first and second end plates and said adjacent portions of said first and second electrical windings, respectively.

* * * * *

UNITED STATES PATENT AND TRADEMARK OFFICE

CERTIFICATE OF CORRECTION

PATENT NO. : 4,095,205

DATED : June 13, 1978

INVENTOR(S) : Stephen M. Schroeder et al.

It is certified that error appears in the above–identified patent and that said Letters Patent are hereby corrected as shown below:

In the front data page, item [73] "Assignee" should read as follows:

Electric Power Research Institute, Inc.
Palo Alto, California

Signed and Sealed this

*Second* Day of *January 1979*

[SEAL]

*Attest:*

RUTH C. MASON
*Attesting Officer*

DONALD W. BANNER
*Commissioner of Patents and Trademarks*